United States Patent [19]

Martin

[11] Patent Number: 4,729,499

[45] Date of Patent: Mar. 8, 1988

[54] HEADBAND FOR FLASHLIGHTS

[76] Inventor: Stanley T. Martin, 106 Sterling Ave., Mt. Sterling, Ky. 40353

[21] Appl. No.: 816,228

[22] Filed: Jan. 6, 1986

[51] Int. Cl.[4] ..... A42B 1/241

[52] U.S. Cl. ..... 224/181

[58] Field of Search ..... 362/105, 190; 224/181, 224/218, 219, 222

[56] References Cited

U.S. PATENT DOCUMENTS

| | | | |
|---|---|---|---|
| 2,263,577 | 11/1941 | Griner | 362/105 |
| 3,254,444 | 6/1966 | Paterson | 362/105 X |
| 4,360,930 | 11/1982 | Blanchard | 362/105 X |
| 4,462,064 | 7/1984 | Schweitzer | 362/105 |
| 4,508,249 | 4/1985 | Kotchy | 224/222 X |

*Primary Examiner*—Henry J. Recla
*Assistant Examiner*—Robert M. Petrik

[57] ABSTRACT

A perforated elastic headband for mounting one or more flashlights on a person's head. Insertion of a flashlight thru two sets of holes in the overlapped ends of the headband secures the flashlight to the headband, provides a method of adjusting the vertical angle of the flashlight, and provides a method of adjusting the circumference of the headband. Utilizing other holes in the headband, another flashlight can be mounted on the opposite side of the head.

3 Claims, 2 Drawing Figures

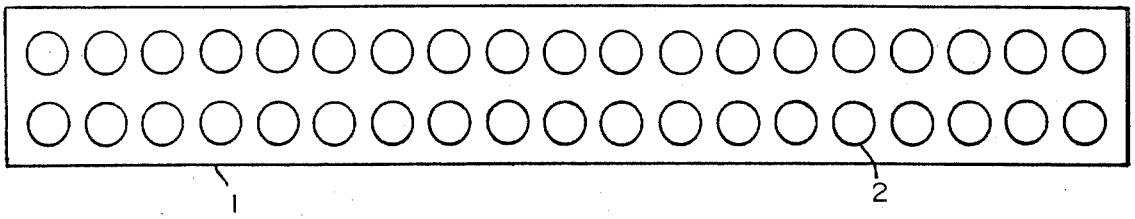
FIG. 1
FIG. 2
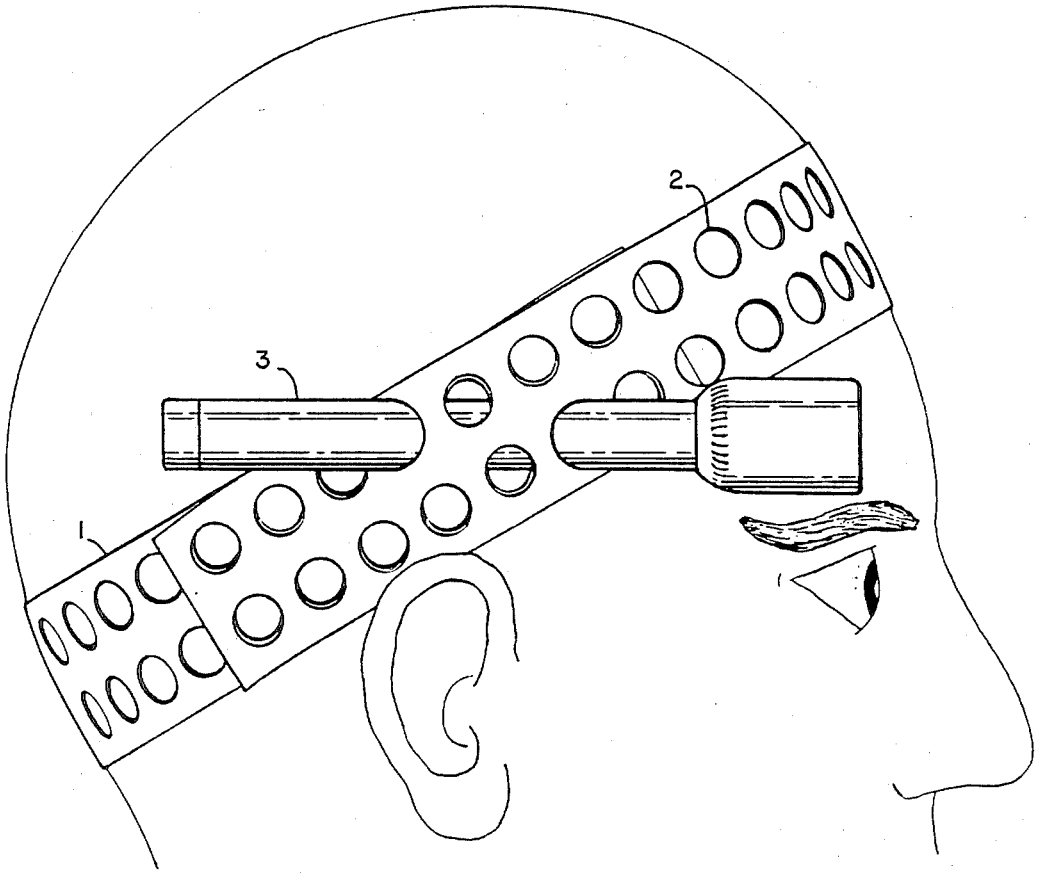

HEADBAND FOR FLASHLIGHTS

BACKGROUND OF THE INVENTION

The present invention relates to portable headlamps, and specifically to headband configurations which can be used to mount a flashlight on the head.

An examination of prior art reveals several designs of headband for mounting a flashlight on the head. Closer examination indicates that they fail to provide certain preferred embodiments of the present invention. For example, the headlamp described by Griner, in U.S. Pat. No. 2,263,577, utilized a flashlight of unique construction, which is no longer being manufactured. The vertical adjustment of this flashlight was limited to the amount the headband could be canted on the head of the wearer.

The headlamp described by Allbritton, in U.S. Pat. No. 3,249,271, utilized a bulky, rigid headband, in which size adjustment was by means of a thumbscrew. A flashlight was secured to the headband by a pair of simple spring-clips, from which it could be dislodged by an impact from any of several directions. Because of the rigidity of the headband, there was no means of horizontal adjustment of the flashlight beam.

Blanchard, in U.S. Pat. No. 4,360,930, describes a clumsy belt affair which, by means of special attachment clips, could be adapted to mount a variety of flashlights on a person's head. Like all other prior art, it makes no provision for affixing more than one flashlight on the head.

Schweitzer, in U.S. Pat. No. 4,462,064, describes a headband which requires the use of a special flashlight with a tapered body. It cannot be used with any other type of flashlight, and it provides no means for vertical adjustment of the flashlight beam. It also provides no means for size adjustment, other than that available thru the inherent elasticity of the headband material.

In U.S. Pat. No. 4,508,249, Kotchy utilizes an elastic band to secure a single C or D-type flashlight to a person's arm. This invention is not designed for, and no provisions are made for, mounting a light on a person's head. As described, the flashlight is attached by pushing each end thru slots in the elastic band. Security is determined entirely by the elasticity of the band material, thus inviting the possibility that one or both ends of the flashlight could be dislodged by an impact. Furthermore, when mounted as intended on the forearm, this invention permits only three positions of angular adjustment of the beam.

SUMMARY OF THE INVENTION

Thru modern technology, there has been developed several types of small, high intensity flashlights. These lights are finding wide use in many sectors of society because of their intensity and reliability. At present, their use has been confined to that of hand lamps, because of no readily available means of mounting them on the head. It many situations, having a light on one's head, and having one's hands free for other tasks, can prove of critical importance. The primary objective of the present invention is to provide a simple, inexpensive, and comfortable means of mounting such flashlights on a person's head.

It is another objective of the present invention to provide a means of readily mounting flashlights on both sides of the head.

Another objective of the present invention is to provide a simple means of adjusting the angle of the flashlight(s) in both vertical and horizontal planes.

A further objective is to provide a headband which can be easily adjusted to fit any size head.

Yet another objective is to provide a means of mounting a flashlight on the head in a secure fashion, so that it cannot be readily dislodged by an accidental impact.

Other objectives and embodiments will become apparent from examination of the accompanying drawings and description.

DESCRIPTION OF THE DRAWINGS

FIG. 1 is a side view of the present invention.

FIG. 2 is a pictorial view showing one of the ways the present invention can be utilized to mount a flashlight on a person's head.

DESCRIPTION OF THE PREFERRED EMBODIMENTS

As can be seen in FIG. 1, this invention consists of a strip of thin elastic material 1 which is perforated with two longitudinal rows of holes 2. FIG. 2 shows how FIG. 1 can be wrapped around the head, in a headband fashion, and the overlapped ends secured by inserting a flashlight 3 thru two sets of holes.

It is obvious that the circumference of the headband, and its tightness on the head, is determined by how much the ends of the elastic strip are overlapped. It is also obvious that the vertical angle of the flashlight, with reference to the plane of the headband, is determined by which two sets of holes the flashlight is inserted thru. This angle can range from horizontal to vertical; thus providing beam angles from zenith to nadir. The vertical angle can also be varied to some degree by canting the headband on the head. Horizontal adjustment of the beam angle can be accomplished by merely rotating the headband on the wearer's head.

This range of angular adjustment allows the flashlight to be used effectively in a variety of ways. Besides the obvious, applications as novel as that of a reading light become possible if the flashlight is pointed downward and rotated to the center of the forehead.

If holes are punched the entire length of the elastic strip, as shown in FIG. 1, a second flashlight can be inserted thru holes on the opposite side of the head (from that of the lapped ends shown in FIG. 2.) This is of great value when the light from one flashlight does not prove sufficient. The angle of the beams of both flashlights can be varied independently, in both vertical and horizontal planes, by choosing the appropriate holes thru which to insert the flashlights, and then making minor positional adjustments of the headband on the head.

Any number of rows of holes could be incorporated into the present invention, but two rows appear to be of optimum practicality. One row allows no vertical adjustment, while three or more result in a headband of excessive width.

The spacing of the holes in the rows shown in FIG. 1 is constant, and adjustment of circumference can be done only in increments equal to the distance between hole centers. The comfort of fit of the headband is the result of this coarse adjustment plus the inherent elasticity of the material. Finer adjustment can be accomplished by having different hole spacing on either half of the headband; thereby providing vernier adjustment capability.

The flashlight is secured into the holes in the headband by the elasticity of the material, and the opposing pull of each end of the band. Both factors contribute to an extremely secure system which precludes the flashlight falling from the headband or being dislodged by an accidental blow.

In consideration of these novel embodiments, what is claimed here is:

1. A headband for securing flashlights on the wearer's head, the headband consists of an elastic strip of material said elastic strip including at least two longitudinal rows of perforations such extending the entire length of said strip, said strip being of sufficient length to surround the wearer's head and including ends which overlap when said strip is worn on the head, said flashlight being inserted into two overlapped longitudinal perforations and longitudinal perforations permitting said headband to be adjustable by inserting said flashlight in a different set of overlapped perforations, said headband also allowing for adjusting the beam angle of said flashlight by inserting said flashlight into different overlapping perforations.

2. A headband, as claimed in claim 1, in which the security and resistance to dislodgment of said flashlight is determined primarily by the opposing pull of the ends of said headband on the body of said flashlight, and secondarily by the elastic properties of said headband material.

3. A headband, as claimed in claim 1, on which a second flashlight can be mounted by inserting it thru two perforations in said band at a location different from that of the flashlight used to secure the ends of said headband.

* * * * *